US005578088A

United States Patent [19]

Schrell et al.

[11] Patent Number: 5,578,088

[45] Date of Patent: Nov. 26, 1996

[54] PROCESS FOR DYEING AMINATED CELLULOSE/POLYESTER BLEND FABRIC WITH FIBER-REACTIVE DISPERSE DYESTUFFS

[75] Inventors: Andreas Schrell, Frankfurt am Main; Werner H. Russ, Flörsheim, both of Germany

[73] Assignee: Hoechst Aktiengesellschaft, Germany

[21] Appl. No.: 496,597

[22] Filed: Jun. 29, 1995

[30] Foreign Application Priority Data

Jun. 29, 1994 [DE] Germany ..... 44 22 707.8

[51] Int. Cl.[6] ..... D06P 3/66; D06P 3/854; D06P 1/38

[52] U.S. Cl. ..... 8/475; 8/493; 8/532; 8/542; 8/565; 8/567; 8/570; 8/572; 8/573; 8/576; 8/599; 8/604; 8/606

[58] Field of Search ..... 8/493, 532, 539–543, 8/597, 599, 565, 567–579, 597–606, 918, 921, 475

[56] References Cited

U.S. PATENT DOCUMENTS

| | | | |
|---|---|---|---|
| 3,959,338 | 5/1976 | Koppe et al. | 558/442 |
| 3,974,160 | 8/1976 | Seiler et al. | 544/187 |
| 4,473,499 | 9/1984 | Niwa et al. | 534/637 |
| 4,515,716 | 5/1985 | Niwa et al. | 534/635 |
| 4,837,309 | 6/1989 | Niwa et al. | 534/632 |
| 5,298,032 | 3/1994 | Schlenker et al. | 8/475 |

FOREIGN PATENT DOCUMENTS

| | | |
|---|---|---|
| 1267490 | 4/1990 | Canada . |
| 2084585 | 6/1993 | Canada . |
| 2101180 | 1/1994 | Canada . |
| 0151370 | 8/1985 | European Pat. Off. . |
| 0286597 | 10/1988 | European Pat. Off. . |
| 0546476 | 6/1993 | European Pat. Off. . |
| 0580091 | 1/1994 | European Pat. Off. . |
| 0638686 | 2/1995 | European Pat. Off. . |
| 2930738 | 5/1980 | Germany . |
| 3906724 | 9/1990 | Germany . |
| 4230325 | 3/1993 | Germany . |
| 4332219 | 3/1994 | Germany . |
| 3-032587 | 2/1991 | Japan . |
| 3-032585 | 2/1991 | Japan . |
| 3-035341 | 2/1991 | Japan . |
| 3-247665 | 11/1991 | Japan . |
| 4-059347 | 2/1992 | Japan . |
| 5-5279 | 1/1993 | Japan . |
| 0564515 | 7/1975 | Switzerland . |
| 2259525 | 3/1993 | United Kingdom . |

*Primary Examiner*—Margaret Einsmann
*Attorney, Agent, or Firm*—Connolly & Hutz

[57] ABSTRACT

Process for dyeing aminated cellulose/polyester blend fabric with fiber-reactive disperse dyestuffs Fiber materials comprising cellulose fibers or a mixture of cellulose and polyester fibers are dyed by first modifying the fiber material with one or more compounds containing amino groups and then dyeing the modified fiber material with a fiber-reactive disperse dyestuff in supercritical $CO_2$.

16 Claims, No Drawings

PROCESS FOR DYEING AMINATED CELLULOSE/POLYESTER BLEND FABRIC WITH FIBER-REACTIVE DISPERSE DYESTUFFS

DESCRIPTION

In the current prior art, alkali-donating agents for fixing and electrolytes for better absorption are necessary for dyeing cotton with reactive dyestuffs in order to achieve satisfactory dyeing results. On the other hand, polyester is dyed at elevated temperatures with disperse dyestuffs which, however, are chemically unstable under alkaline conditions.

DE-A-39 06 724 describes a process for dyeing textile substrates in which a supercritical fluid comprising a dyestuff flows over or flows through the substrates. Both disperse and anionic dyestuffs can be employed, depending on the nature of the fluid and of the substrate. Coloring of cotton, also with reactive dyestuffs, is in principle possible by this process, but alkaline auxiliaries are also still required in order to bond the reactive dyestuff covalently to the substrate and thus to achieve the current fastness level requirements.

On the other hand, U.S. Pat. No. 5,298,032 reports that textile materials of cellulose can be colored with disperse dyestuffs by the abovementioned process only unsatisfactorily, and in many cases even only as stained fabric. This problem is solved by pretreating the textile beforehand with an agent which promotes absorption of the dyestuff. Nothing is stated about the fastness properties of a textile dyed in this way, but the fastnesses to washing and rubbing are below the level required for reactive dyestuffs.

There is therefore a need for a method of dyeing textile fibers, preferably those which comprise the parent substance of α-β-glucose and of polyester at the same time, in one bath using only one class of dyestuff without colored waste waters being obtained.

With the present invention, it has now been found that level and deep dyeings having very good fastness properties in use, in particular fastnesses to washing and rubbing, are obtained in a surprising manner with fiber-reactive disperse dyestuff without using agents having an alkaline action if a cellulosic fiber or mixed fiber material which has been modified beforehand by compounds containing amino groups is used and if the dyeing process is carried out in supercritical $CO_2$.

The present invention relates to a process for dyeing fiber materials comprising cellulose fibers or a mixture of cellulose fibers and polyester fibers, which comprises first modifying the fiber material with one or more compounds containing amino groups and then dyeing the modified fiber material with a fiber-reactive disperse dyestuff in supercritical $CO_2$.

Because of their chemical structure, fiber-reactive disperse dyestuffs are capable of reacting both with cotton and with polyester materials at appropriate temperatures. Fiber-reactive disperse dyestuffs are dyestuffs which, in addition to the fiber-reactive group, contain no group which confers water-solubility, the fiber-reactive group itself not being or having a group which confers water-solubility.

The dyestuffs which are employed according to the invention are described, for example, in U.S. Pat. No. 39,74,160, U.S. Pat. No. 3,959,338 and Japanese Laid-Open Specification JP-3-247,665; U.S. Pat. No. 4,837,309 U.S. Pat. No. 4,515,761 and U.S. Pat. No. 4,473,499. The water-insoluble disperse dyestuffs mentioned in these specifications contain so-called fiber-reactive radicals. Those molecular parts which can react with hydroxyl groups, for example of cellulose, or amino and thiol groups, for example of wool and silk, of synthetic polymers, such as polyamides, or also aminated celluloses and are capable of undergoing covalent chemical bonding are in general to be understood as being fiber-reactive.

Compounds which contain amino groups and are suitable for modification of the fiber material are described in CA-A-2 084 585, CA-A-2 101 180 , EP-A-O 286 597 CA-A-1 267 490 and in Japanese Laid-Open Specification Hei-5-5279 and in DE-A-29 30 738 .

Compounds which can preferably be used for modification of fiber materials are compounds described, for example, in CA-A-2 101 180 corresponding to the formula (1)

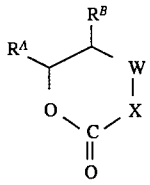

(1)

in which:

$R^A$ is hydrogen or alkyl having 1 to 3 carbon atoms, which can be substituted by hydroxyl or a group of the formula (2 ) or (3 )

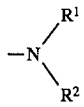

(2)

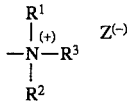

(3)

in which $R^1$ is hydrogen, methyl or ethyl, $R^2$ is hydrogen, methyl or ethyl and $R^3$ is hydrogen, methyl or ethyl or $R^1$and $R^2$ together with the N atom are a saturated heterocyclic radical formed from an alkylene radical having 5 to 8 carbon atoms or two alkylene radicals having 1 to 4 carbon atoms and an oxygen atom or an amino group of the formula —NH—, such as, for example, the N-piperazine, N-piperidine or N-morpholine radical and $Z^{(-)}$ is an anion, such as, for example, the chloride, hydrogen sulfate or sulfate anion;

$R^B$ has one of the meanings given for $R^A$;

W is a direct bond or a group of the formula —$CHR^c$—, in which $R^c$ has one of the meanings given for $R^A$; and X is a group —O— or —NH—.

Preferably, only one of the radicals $R^A$, $R^B$ and $R^C$ is an alkyl group with a group of the formula (2) or (3).

Such hetero-cycloaliphatic compounds which can be used according to the invention are, for example, 2-oxo1,3-oxazolidine, 4-aminomethyl-2-oxo-1,3-oxazolidine, 5-aminomethyl-2-oxo-1,3-oxazolidine, 4-(trimethyl-ammonium-methyl)-2-oxo-1,3-oxazolidine chloride, 5-(trimethylammonium-methyl)-2-oxo-1,3-oxazolidinechloride and 1-(trimethylammonium-methyl)ethylene carbonate chloride.

The compounds which can be used according to the invention can be prepared in accordance with known procedures, such as are described in numerous instances in the literature (cf. Houben-Weyl, Methoden der Organischen Chemie [Methods of Organic Chemistry], 4th Edition, Volume E4, pages 82–88 and 192 et seq.), for example by reaction of an alkanediol which has a latent nitrogen-containing functional group in the side chain with phosgene in aqueous solution at a pH of between 7 and 9, for the preparation of the hetero-cycloaliphatic carbonates, or, for example, by reaction of aminoalkanols with phosgene in aqueous solution to give the heterocycloaliphatic carbamic acid compounds (2-oxo-1,3-oxazolidines).

Aliphatic compounds which can be used according to the invention and contain amino and ester groups are, for example, the compounds described in EP-A-0 546 476 which correspond to the formulae (1a) and (1b)

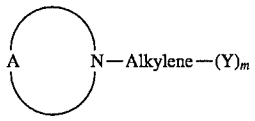

(1a)

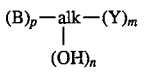

(1b)

in which:

Y is an ester group;

A and N together with 1 or 2 alkylene groups having 1 to 4 carbon atoms form the bivalent radical of a heterocyclic ring, preferably a 5- or 6-membered heterocyclic ring, such as, for example, the piperazine, piperidine or morpholine ring, in which A is an oxygen atom or a group of the formula (a), (b) or (c)

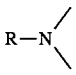

(a)

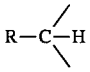

(b)

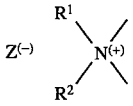

(c)

in which

R is a hydrogen atom or an amino group, or an alkyl group having 1 to 6 carbon atoms, preferably 1 to 4 carbon atoms, which can be substituted by 1 or 2 substituents from the group consisting of amino, sulfo, hydroxyl, sulfato, phosphato and carboxyl, or an alkyl group having 3 to 8 carbon atoms, preferably 3 to 5 carbon atoms, which is interrupted by 1 or 2 hetero groups chosen from the groups —O- and —NH— and can be substituted by an amino, sulfo, hydroxyl, sulfato or carboxyl group, $R^1$ is hydrogen, methyl or ethyl, $R^2$ is hydrogen, methyl or ethyl and $Z^{(-)}$ is an anion, such as, for example, the chloride, hydrogen sulfate or sulfate anion;

B is the amino group of the formula $H_2N$- or an amino or ammonium group of the formula (d) or (e)

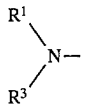

(d)

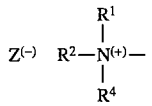

(e)

in which $R^1$, $R^2$ and $Z^{(-)}$ has one of the abovementioned meanings and $R^3$ is methyl or ethyl and $R^4$ is hydrogen, methyl or ethyl;

P is the number 1 or 2, preferably 1;

alkylene is a straight-chain or branched alkylene radical having 2 to 6 carbon atoms, preferably 2 to 4 carbon atoms, which can be substituted by 1 or 2 hydroxyl groups, or is a straight-chain or branched, preferably straight-chain, alkylene radical having 3 to 8 carbon atoms, preferably 3 to 5 carbon atoms, which is interrupted by 1 or 2 hetero groups chosen from the groups —O— and —NH—;

alk is a straight-chain or branched alkylene radical having 2 to 6 carbon atoms, preferably 2 to 4 carbon atoms, or is a straight-chain or branched, preferably straight-chain, alkylene radical having 3 to 8 carbon atoms, preferably 3 to 5 carbon atoms, which is interrupted by 1 or 2 hetero groups chosen from the groups —O— and —NH—, and is preferably a straight-chain or branched alkylene radical having 2 to 6 carbon atoms, preferably 2 to 4 carbon atoms;

m is the number 1 or 2, preferably 1;

n is a number from 1 to 4, preferably 1 or 2; and the amino, hydroxyl and ester groups can be bonded either to a primary, secondary or tertiary carbon atom of the alkylene radical.

Such compounds containing ester and amino groups which can be used according to the invention are, for example, N-(β-sulfatoethyl)-piperazine, N-(β-sulfatoethyl)-piperazine sulfate, N-[β-(β'-sulfatoethoxy)-ethyl]-piperazine, N-(γ-sulfato-β-hydroxypropyl)-piperidine, N-(γ-sulfato-β-hydroxypropyl)-pyrrolidine, N-(β-sulfato-ethyl)-piperidine, ethyl)-piperidine, the salts of 3-sulfato-2-hydroxy1-(trimethylammonium)-propane, such as 3-sulfato-2-hydroxy-1-(trimethylammonium)-propane-sulfate, 2-sulfato3-hydroxy-1-aminopropane, 3-sulfato-2-hydroxy-1-aminopropane, 1-sulfato-3-hydroxy-2-aminopropane, 3-hydroxy-1-sulfato-2-aminopropane, 2,3-disulfato-1-aminopropane and 1,3-disulfato-2-aminopropane and derivatives of these compounds with another ester group instead of the sulfato group, such as with the phosphato, acetyloxy, p-tosyloxy and 3,4,5-trimethylphenylsulfonyloxy group.

The corresponding compounds containing hydroxyl groups can be used as starting substances for preparation of the compounds which can be used according to the invention, and the hydroxyl groups can be esterified in the customary manner by reaction with the acids or the corresponding acylating agents, preferably only one of these hydroxyl groups being esterified if compounds containing amino groups which have more than one hydroxyl group are used as starting substances. Such procedures are known in the literature; the compounds which can be used according to the invention can be prepared by procedures analogous to such known procedures.

The processes for carrying out the modification of the fiber material are described in the laid-open specifications mentioned.

Fiber materials which are employed according to the invention are all the polymers which contain the basic skeleton of α,β-glucose by themselves or as a mixture with polyester fibers.

The textile modified fiber material employed in the dyeing process according to the invention can be in all the processing states, that is to say in the form of yarn, flock, combed sliver and piece goods (fabric).

The dyeing according to the invention from supercritical carbon dioxide is carried out, for example, by introducing the modified textile material into a pressure-tight dyeing apparatus together with the fiber-reactive disperse dyestuff in solid form and heating up the apparatus to the dyeing temperature under a $CO_2$ pressure, or by heating up the apparatus and establishing the desired $CO_2$pressure. $CO_2$ is preferably introduced into the dyeing apparatus in the form of dry ice or recondensed from linked installations of comparable pressure. The dyeing temperatures used for modified cotton fibers in the process according to the invention are between 70 and 200° C., preferably between 100° and 150° C., and those for cellulose/polyester blend fabric are between 120° and 210° C., preferably 120 and 150° C.

The pressure to be used in the process according to the invention must be at least high enough for the $CO_2$ to be in the supercritical state. This pressure usually varies between 30 and 400 bar, preferably between 140 bar and 250 bar. At the preferred dyeing temperature for cellulose materials of about 130° C., the pressure is about 200 bar.

The liquor ratio during dyeing varies between a value of 1:2 and 1:100. After the dyeing temperature has been reached, the desired pressure is established, if this has not already been reached as a result of the increase in temperature. The temperature and pressure are then kept constant for some time, for example 0.5 to 60 minutes, intensive, thorough mixing of the textile material and dye liquor being assured by suitable measures, for example circulation of the dye liquors. After the dyeing process, the pressure is reduced, which is done either by opening the valve and releasing the pressure rapidly or in several stages.

In the following examples, "parts" are parts by weight.

EXAMPLE 1

5 parts of a polyester/cotton blend fabric pretreated in accordance with Example 19a fo CA-A 2 084 585, which corresponds to U.S. Pat. No. 5,507,840, are dried and brought together with 0.1 part of the yellow dyestuff of the formula

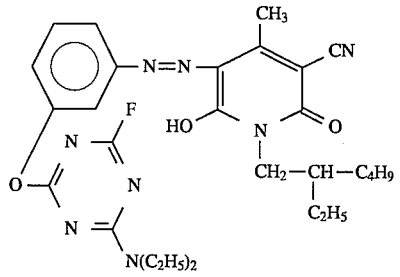

and 330 g of solid $CO_2$ in a 0.5 liter autoclave. After the autoclave has been closed, the contents are heated to 130° C., a pressure of about 225 bar being established. The temperature is kept constant for 30 minutes and the autoclave is cooled slowly and let down in stages. A deep yellow dyeing having very good fastness properties during use is obtained.

EXAMPLE 2

5 parts of a cotton fabric pretreated in accordance with Example 12a of CA-A 2 084 585, which corresponds to U.S. Pat. No. 5,507,840, are dried and brought together with 0.1 part of the dyestuff from DE-A-20 08 811, Example 102, and 330 g of solid $CO_2$ in a 0.5 liter autoclave. The further procedure corresponds to the instructions of Example 1 of this Application, and a deep level yellow dyeing which is equivalent in its fastness properties in all points to those of a dyeing achieved according to the prior art is obtained.

FURTHER EXAMPLES

The procedure for dyeing of pretreated cotton or cotton blend fabric is as according to the instructions of Examples 1 and 2, and dyeing is carried out using the fiber-reactive disperse dyestuffs listed below by the process described above to give similarly good results:

| Example | Fiber-reactive disperse dyestuff | Color shade of the dyeing |
|---|---|---|
| 3 | 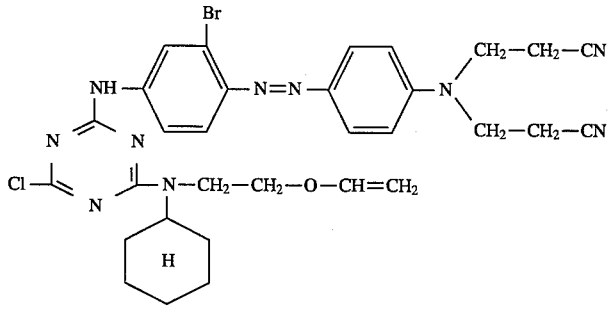 | red |

-continued
| Example | Fiber-reactive disperse dyestuff | Color shade of the dyeing |
|---|---|---|
| 4 | 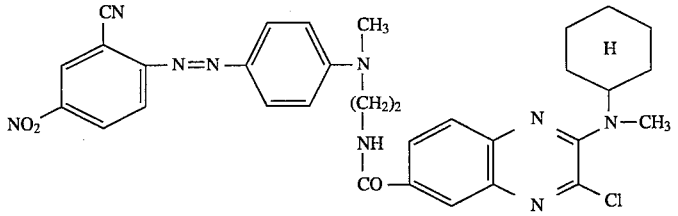 | violet |
| 5 | 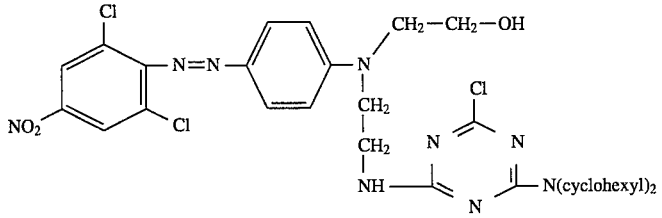 | brown |
| 6 | 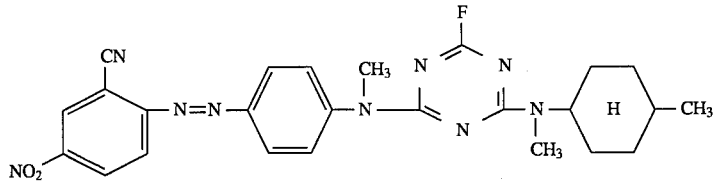 | yellow |
| 7 | 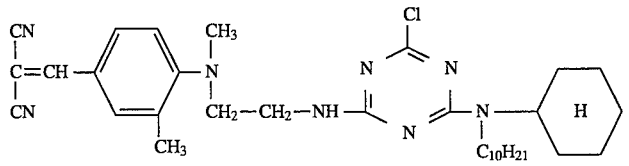 | greenish yellow |
| 8 | 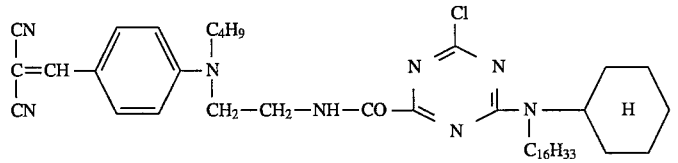 | greenish yellow |
| 9 | 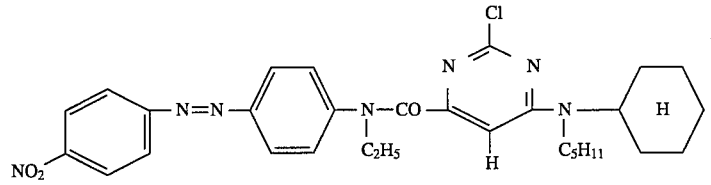 | yellow |
| 10 | 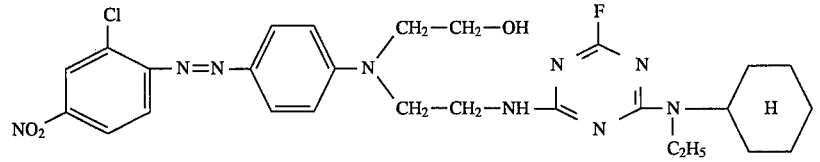 | claret |
| 11 | 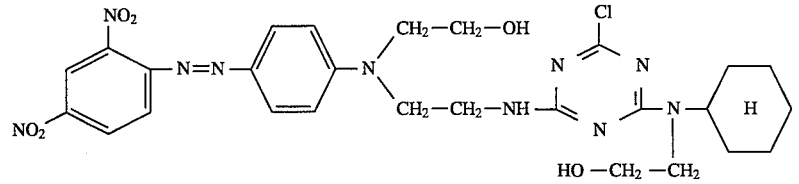 | violet |

-continued
| Example | Fiber-reactive disperse dyestuff | Color shade of the dyeing |
|---|---|---|
| 12 | 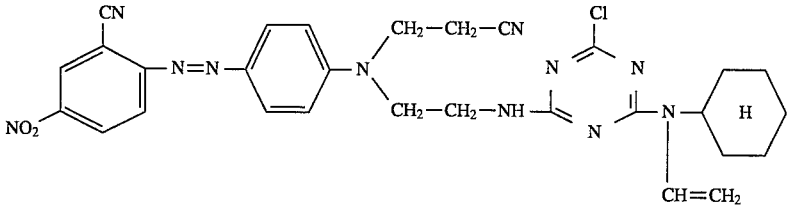 | violet |
| 13 | 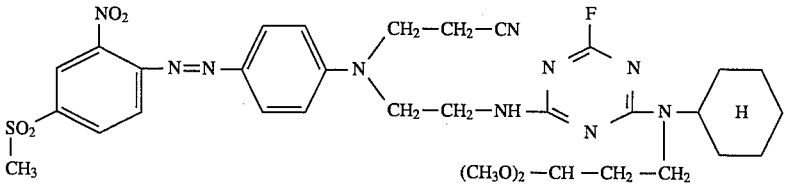 | red |
| 14 | 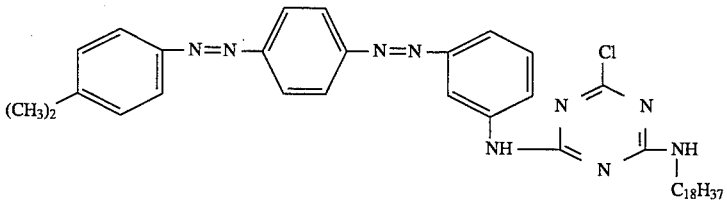 | reddish yellow |
| 15 | 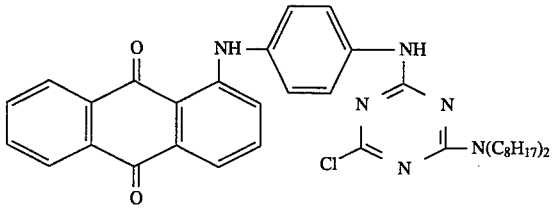 | red-violet |
| 16 | 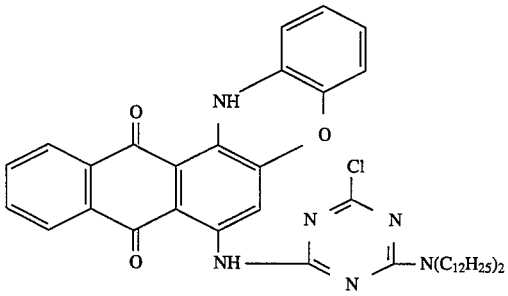 | greenish blue |
| 17 | 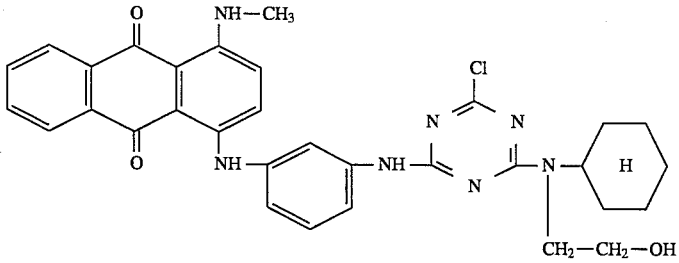 | blue |
| 18 | 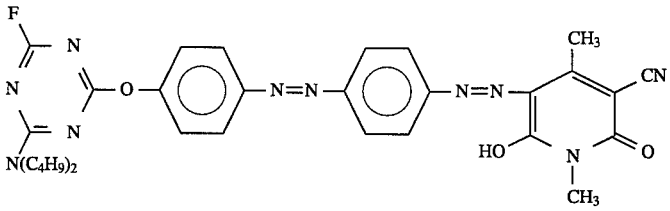 | orange |

-continued
| Example | Fiber-reactive disperse dyestuff | Color shade of the dyeing |
|---|---|---|
| 19 | 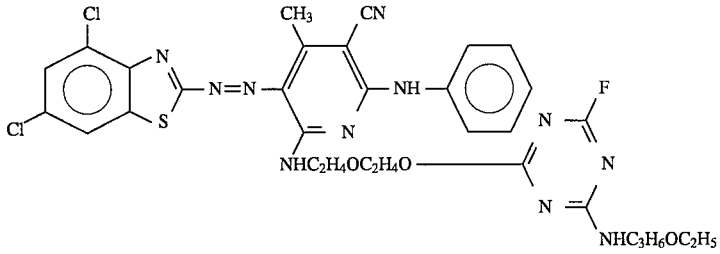 | red |
| 20 | 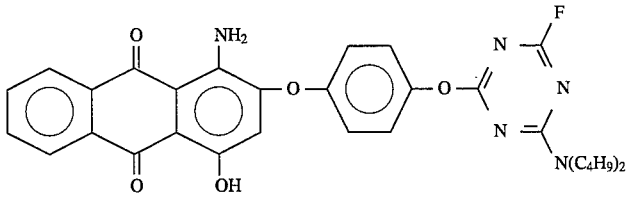 | pink |
| 21 | 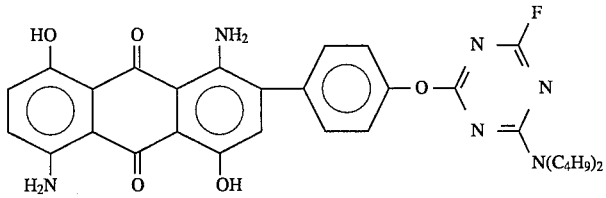 | blue |
| 22 | 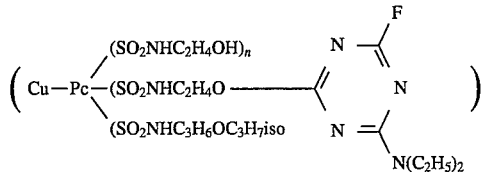 | turquoise |
| 23 | 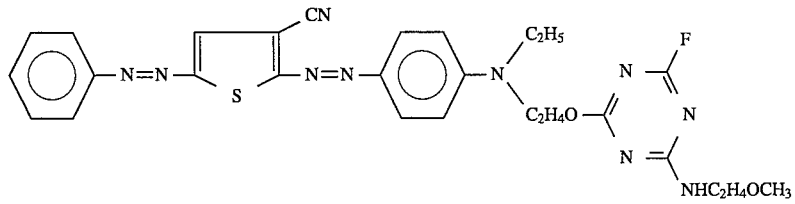 | navy blue |
| 24 | Mixture of Example 18 and 23 | black |
| 25 | 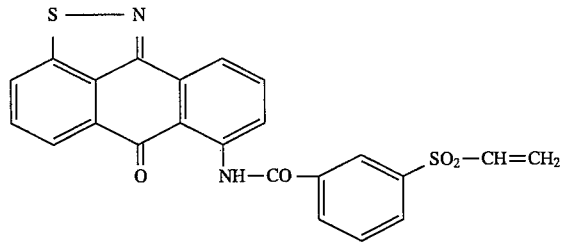 | yellow |
| 26 | 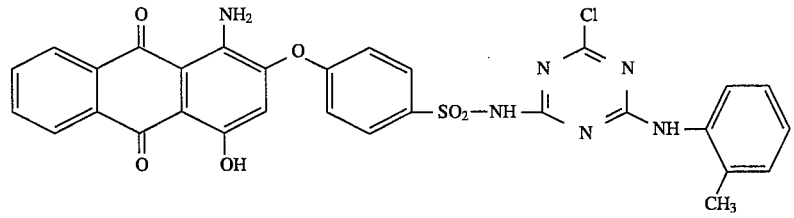 | red |

-continued
| Example | Fiber-reactive disperse dyestuff | Color shade of the dyeing |
|---|---|---|
| 27 | 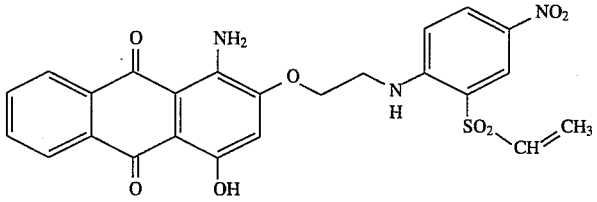 | red |
| 28 | 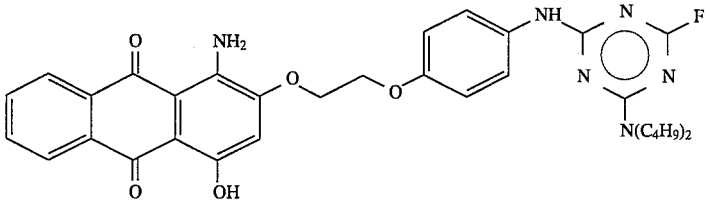 | red |
| 29 | 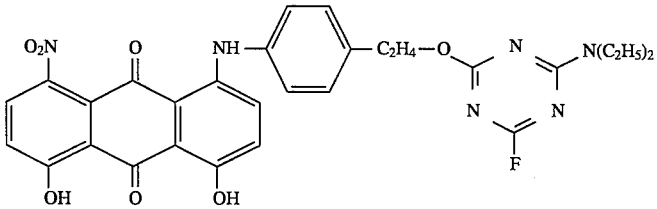 | blue |
| 30 | 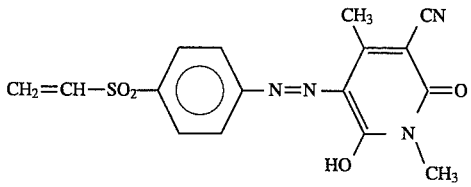 | yellow |
| 31 | 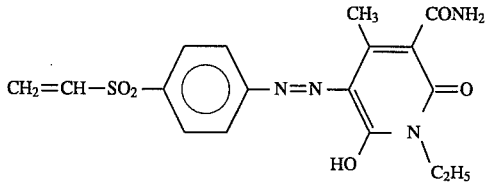 | yellow |
| 32 | 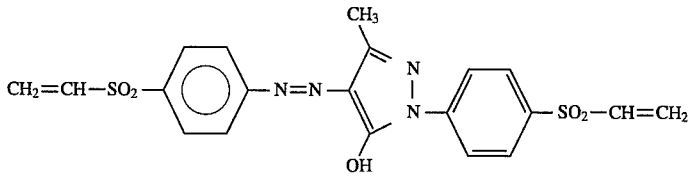 | yellow |
| 33 | 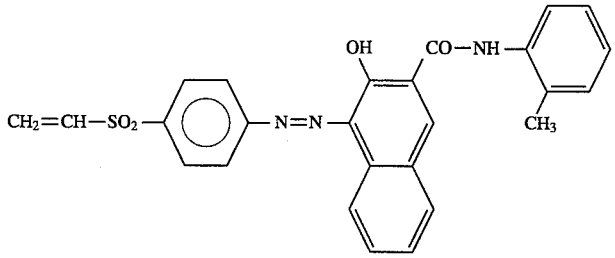 | red |
| 34 | 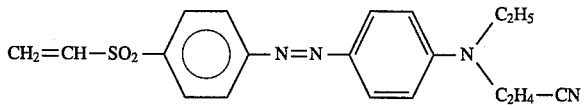 | orange |

-continued

| Example | Fiber-reactive disperse dyestuff | Color shade of the dyeing |
|---|---|---|
| 35 | 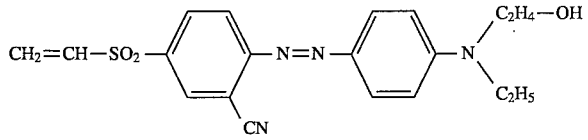 | scarlet |
| 36 | 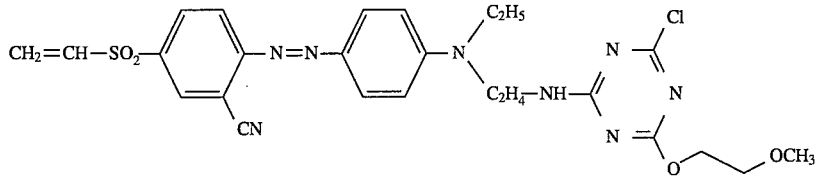 | scarlet |
| 37 | 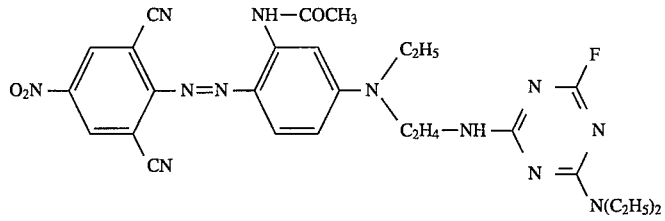 | blue |

We claim:

1. A process for dyeing fiber materials comprising cellulose fibers or a mixture of cellulose fibers and polyester fibers, which comprises first modifying the fiber material with one or more compounds containing amino groups and then dyeing the modified fiber material with a fiber-reactive disperse dyestuff in supercritical $CO_2$ at a temperature of 70–210 degrees centigrade and a $CO_2$ pressure of 30–400 bar, wherein the compound containing amino groups corresponds to the formula (I)

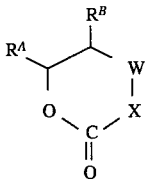

(1)

in which $R^A$ is hydrogen or alkyl having 1 to 3 carbon atoms, which optionally is substituted by hydroxyl or a group of the formula (2) or (3)

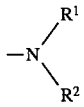

(2)

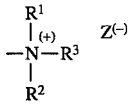

(3)

in which $R^1$ is hydrogen, methyl or ethyl, $R^2$ is hydrogen, methyl or ethyl and $R^3$ is hydrogen, methyl or ethyl or $R^1$ and $R^2$ together with the N atom are a saturated heterocyclic radical formed from an alkylene radical having 5 to 8 carbon atoms or two alkylene radicals having 1 to 4 carbon atoms and an oxygen atom or an amino group of the formula —NH—, $Z^{(-)}$ is an anion, $R^B$ has one of the meanings given for $R^A$;

W is a direct bond or a group of the formula —$CHR^c$—, in which $R^c$ has one of the meanings given for $R^A$; and X is a group —O— or —NH— except when X=O, a group (2) or (3) must be present.

2. The process as claimed in claim 1, wherein the compound containing amino groups is 2-oxo-1,3-oxazolidine, 4-aminomethyl-2-oxo-1,3-oxazolidine, 5-aminomethyl-2-oxo-1,3-oxazolidine, 4-(trimethyl-ammonium-methyl)-2-oxo-1,3-oxazolidine chloride, 5-(trimethylammonium-methyl)-2-oxo-1,3-oxazolidine chloride and 1-(trimethylammonium-methyl)ethylene carbonate chloride.

3. The process as claimed in claim 1, wherein, in the case of cellulose fiber materials, the dyeing temperature is between 70° and 200° C.

4. The process as claimed in claim 1, wherein, in the case of cellulose fiber materials, the dyeing temperature is between 100° and 150° C.

5. The process as claimed in claim 1, wherein, in the case of cellulose fiber/polyester fiber mixtures, the dyeing temperature is between 130° and 210° C.

6. The process as claimed in claim 1, wherein, in the case of cellulose fiber/polyester fiber mixtures, the dyeing temperature is between 130° and 150° C.

7. The process as claimed in claim 1, wherein the $CO_2$ pressure is 140to 250 bar.

8. A process for dyeing fiber materials comprising cellulose fibers or a mixture of cellulose fibers and polyester fibers, which comprises first modifying the fiber material with one or more compounds containing amino groups and then dyeing the modified fiber material with a fiber-reactive disperse dyestuff in supercritical $CO_2$ at a temperature of 70–210 degrees centigrade and a $CO_2$ pressure of 30–400 bar, wherein the compound containing amino groups corresponds to the formula (1a) or (1b)

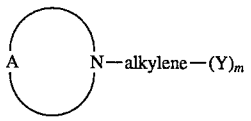

(1a)

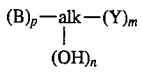

(1b)

in which:

Y is an ester group;

A and N together with 1 or 2 alkylene groups having 1 and 4 carbon atoms form the bivalent radical of a 5- or 6-membered heterocyclic ring, in which A is an oxygen atom or a group of the formula (a), (b) or (c)

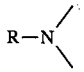

(a)

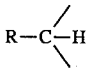

(b)

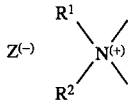

(c)

in which

R is a hydrogen atom or an amino group, or an alkyl group having 1 to 6 carbon atoms, which is optionally substituted by 1 or 2 substituents from the group consisting of amino, sulfo, hydroxyl, sulfato, phosphato and carboxyl, or is an alkyl group having 3 to 8 carbon atoms, which is interrupted by 1 or 2 hetero groups chosen from the groups —O— and —NH— and is optionally substituted by an amino, sulfo, hydroxyl, sulfato or carboxyl group, $R^1$ is hydrogen, methyl or ethyl, $R^2$ is hydrogen, methyl or ethyl and $Z^{(-)}$ is an anion;

B is the amino group of the formula $H_2N$- or an amino or ammonium group of the formula (d) or (e)

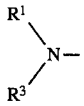

(d)

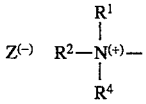

(e)

in which $R^1$, $R^2$ and $Z^{(-)}$ has one of the abovementioned meanings and $R^3$ is methyl or ethyl and $R^4$ is hydrogen, methyl or ethyl;

p is the number 1 or 2;

alkylene is a straight-chain or branched alkylene radical having 2 to 6 carbon atoms, which is optionally substituted by 1 or 2 hydroxyl groups, or is a straight-chain or branched alkylene radical having 3 to 8 carbon atoms, which is interrupted by 1 or 2 hetero groups chosen from the groups —O— and —NH—;

alk is a straight-chain or branched alkylene radical having 2 to 6 carbon atoms, or is a straight-chain chain or branched, alkylene radical having 3 to 8 carbon atoms, which is interrupted by 1 or 2 hetero groups chosen from the groups —O— and —NH—, m is the number 1 or 2;

n is a number from 1 to 4 ; and the amino, hydroxyl and ester groups can be bonded either to a primary, secondary or tertiary carbon atom of the alkylene radical.

9. The process as claimed in claim 8, wherein, in the case of cellulose fiber materials, the dyeing temperature is between 70° and 200° C.

10. The process as claimed in claim 8, wherein, in the case of cellulose fiber materials, the dyeing temperature is between 100° and 150° C.

11. The process as claimed in claim 8, wherein, in the case of cellulose fiber/polyester fiber mixtures, the dyeing temperature is between 130° and 210° C.

12. The process as claimed in claim 8, wherein, in the case of cellulose fiber/polyester fiber mixtures, the dyeing temperature is between 130° and 150° C.

13. The process as claimed in claim 8, wherein the $CO_2$ pressure is 140 to 250 bar.

14. The process as claimed in claim 12, wherein the $CO_2$ pressure is 140 to 250 bar.

15. The process as claimed in claim 8, wherein, in the compounds of the formulae (1*a*) and (1b), A and N together form a piperazine, piperidine or morpholine ring, R is a hydrogen atom, an alkyl group having 1 to 4 carbon atoms, which is optionally substituted by 1 or 2 substituents from the group consisting of amino, sulfo, hydroxyl, sulfato, phosphato and carboxyl, or is an alkyl group having 3 to 5 carbon atoms, which is interrupted by 1 or 2 hetero groups —O— or —NH—;

$Z^{(-)}$ is a chloride, hydrogen sulfate or sulfate anion;

p is the number 1;

alkylene is a straight-chain or branched alkylene radical having 2 to 4 carbon atoms, which is optionally substituted by 1 or 2 hydroxyl groups, or is a straight-chain alkylene radical having 3 to 5 carbon atoms, which is interrupted by 1 or 2 hetero groups —O— or —NH—;

alk is a straight-chain or branched alkylene radical having 2 to 4 carbon atoms, or is a straight-chain alkylene radical having 3 to 5 carbon atoms, which is interrupted by 1 or 2 hetero groups —O— or —NH—;

m is the number 1 and n is the number 1 or 2.

16. The process as claimed in claim 8 wherein the compound containing amino groups is N-(β-sulfatoethyl)-piperazine, N-(-sulfatoethyl)-piperazine sulfate, N-[β-(β'-sulfatoethoxy)-ethyl]-piperazine, N-(γ-sulfato-β-hydroxypropyl)-piperidine, N-(γ-sulfato-β-hydroxypropyl)-pyrrolidine, N-(β-sulfato-ethyl)-piperidine, a salt of 3-sulfato-2-hydroxy-1-(trimethylammonium)-propane, 2-sulfato-3-hydroxy-1aminopropane, 3-sulfato-2-hydroxy-1-aminopropane, 1-sulfato-3-hydroxy-2-aminopropane, 3-hydroxy-1-sulfato-2-aminopropane, 2,3-disulfato-1-aminopropane and 1,3-disulfato-2-aminopropane or a derivative of one these compounds with a phosphato, acetyloxy, p-tosyloxy or 3,4,5-trimethyl-phenylsulfonyloxy ester group.

* * * * *